Figure 1:
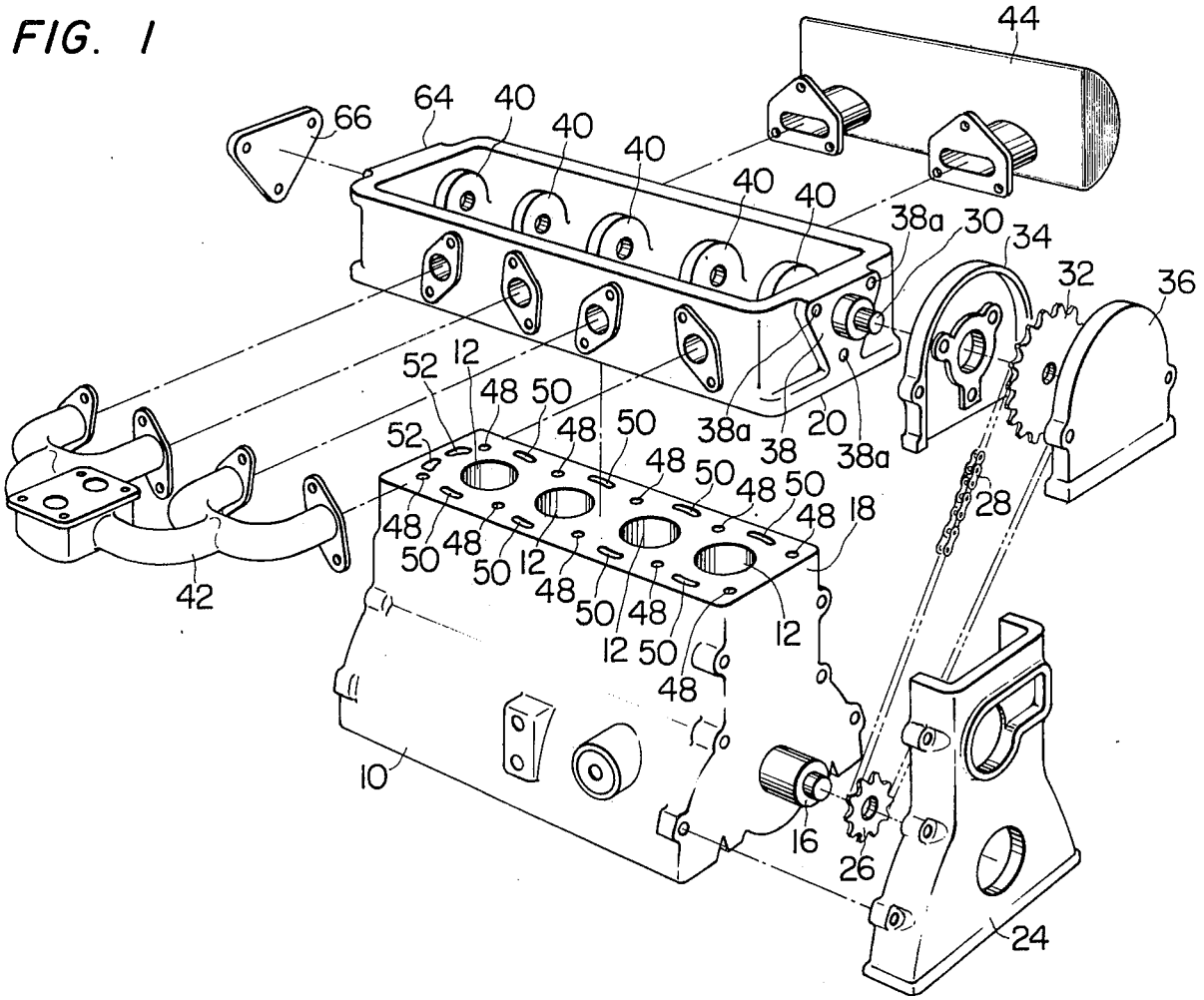

INTERNAL COMBUSTION ENGINE ASSEMBLY

The present invention relates generally to an internal combustion engine of the overhead cam type and more particularly to an assembly thereof.

A known internal combustion engine of the overhead cam type comprises a cylinder block and a cylinder head secured to the cylinder block by means of a number of tightening bolts. A cam shaft of the engine rotatably supported on the cylinder head is driven by the engine crank shaft through a timing chain to operate inlet and exhaust valves. The timing chain is accommodated in a chain over attached to one of two longitudinally spaced end faces of the cylinder block. An intake system including an intake manifold and a carburetor is arranged on one side of the crank shaft by attaching the intake manifold adjacent to one of two lateral faces of the cylinder head, while an exhaust system including an exhaust manifold or an exhaust converter is arranged on the opposite side of the crank shaft by attaching the exhaust system to the opposite lateral face of the cylinder head. The exhaust system may be arranged on the same side of the crank shaft as the intake system is arranged.

In longitudinally mounting the engine in a front engine compartment of an automobile with a driver's seat on the righthand side of its passenger compartment, the intake system must be arranged on the righthand side of the crank shaft by attaching the intake manifold to that lateral face of the cylinder head which is disposed on the righthand side of the crank shaft when viewed in the forward direction of the vehicle in order to simplify a control linkage for the carburetor, and it is the common practice to dispose the cylinder head with the chain cover facing forwardly and to design the cylinder head so as to have the intake manifold attached to that lateral face of the cylinder head which is disposed on the righthand side of the crank shaft when viewed in the forward direction of the vehicle. In transversely mounting the engine in a front engine compartment of an automobile, the cylinder block must be arranged such that the rotational direction of the crank shaft agrees with the forward rotational direction of road wheels of the vehicle for the sake of simple transmission of the engine power and the intake system must be arranged rearwardly of the cylinder block, and it is the common practice to dispose the cylinder block with the chain cover facing laterally and rightwardly of the vehicle when viewed in the forward direction of the vehicle and to design the cylinder head so as to have the intake manifold attached to that lateral face of the cylinder head which is disposed on the lefthand side of the crank shaft when viewed in a direction along the crank shaft toward the chain over. It will be noted that for the longitudinal engine mount, the cylinder head must be provided with an attachment surface for the intake manifold on the righthand lateral face of the cylinder head when viewed in a direction along the crank shaft toward the chain cover, while for the transverse engine mount, the cylinder head must be provided with an attachment surface for the intake manifold on the lefthand lateral face of the cylinder head when viewed in a direction along the crank shaft toward the chain cover. It follows that a cylinder head designed for the longitudinal engine mount must be replaced by another cylinder head designed for the transverse engine mount when the engine is to be mounted transversely. This is a problem for car manufacturers producing an automobile with a transversely mounted engine as well as an automobile with a longitudinally mounted engine because two kinds of cylinder heads must be prepared and produced for the same kind of engine. It will be seen that the same problem is encountered in the case that an engine having a cylinder head designed for longitudinal mount in a front engine compartment of an automobile with a driver's seat on the righthand side in a passenger compartment is to be mounted transversely in a front engine compartment of an automobile with a driver's seat on the lefthand side in a passenger compartment.

Thus there is a growing need among car manufacturers for an internal combustion engine assembly which allows an intake manifold to be arranged on any desired one side of a crank shaft of the engine without any replacement of parts of the engine.

The present invention satisfies the above need by modifyng a cylinder head of an internal combustion engine so that the cylinder head to which an intake manifold is adapted to be attached has two assembled positions on a cylinder block of the engine, one assembled position being pivoted 180° from the other assembled position.

It is a primary object of the present invention to provide an internal combustion engine assembly having a cylinder head which has two assembled positions on a cylinder block of the engine.

Figure 2A:
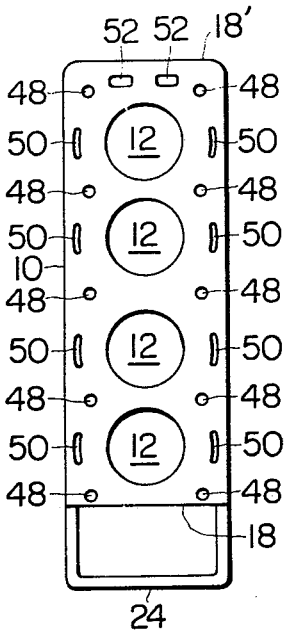
Figure 2B:
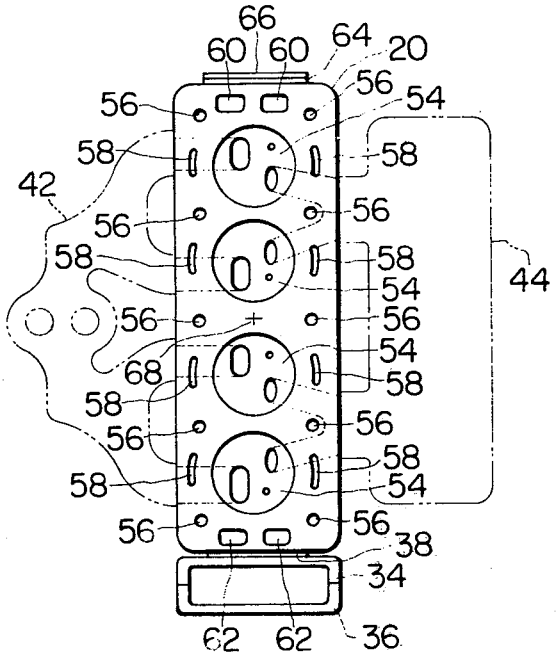
Figure 3:
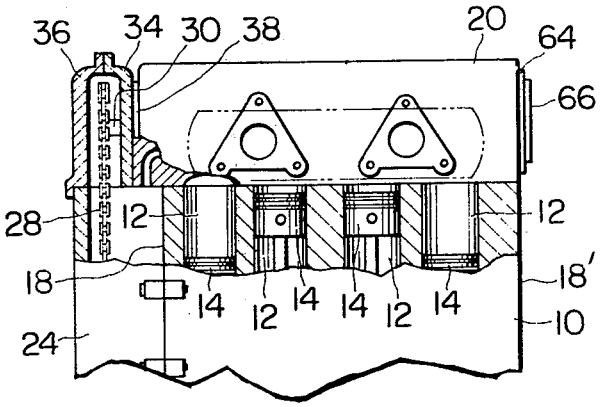
Figure 4A:
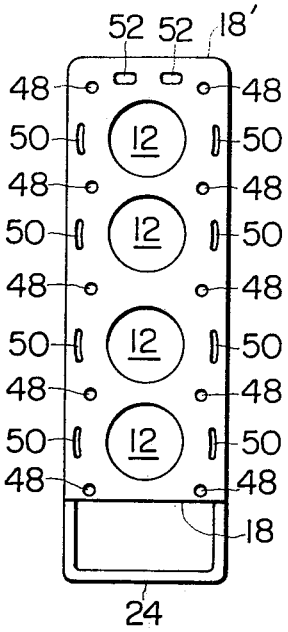
Figure 4B:
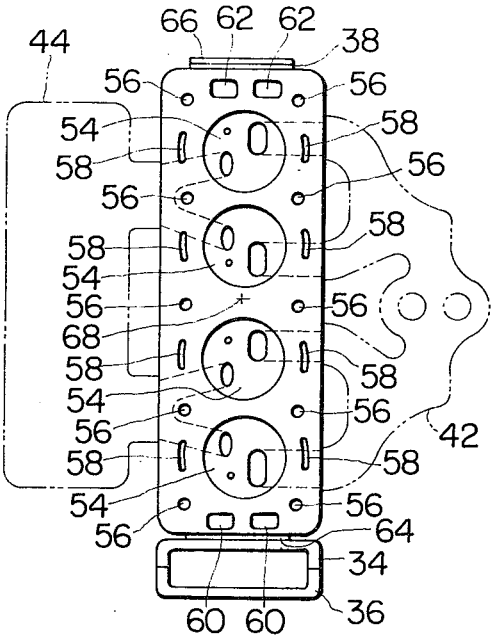
Figure 5:
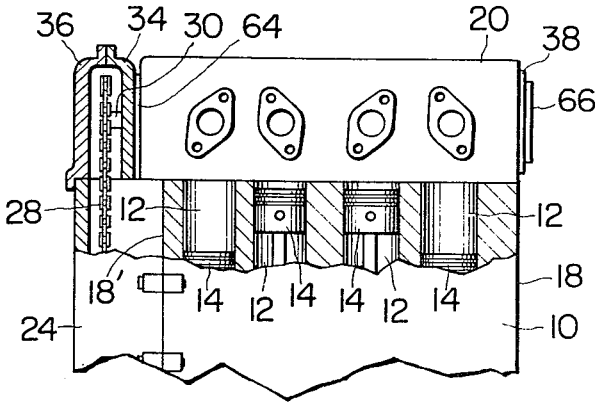

Other objects and advantages of the present invention will become apparent from the following description in connection with the accompanying drawings, in which:

FIG. 1 is an exploded view of an internal combustion engine assembly according to the present invention;

FIGS. 2*a* and 2*b* are top and bottom views of the cylinder block and the cylinder head, respectively, illustrating contacting surfaces of the cylinder head and the cylinder block of the engine when the cylinder head is to be assembled at one of the two assembled positions on the cylinder block;

FIG. 3 is a side, partly broken away, view of the engine shown in FIG. 1, illustrating the cylinder head secured to the cylinder block at the one assembled position on the cylinder block;

FIGS. 4*a* and 4*b* are top and bottom views of the cylinder block and the cylinder head, respectively, illustrating contacting surfaces of the cylinder head and the cylinder block of the engine when the cylinder head is to be assembled at the other assembled position on the cylinder block; and FIG. 5 is a side, partly broken away, view of the engine shown in FIG. 1, illustrating the cylinder head secured to the cylinder block at the other assembled position on the cylinder block.

Referring to the accompanying drawings, FIGS. 1—3 show a four cylinder internal combustion engine with its cylinder head having one of two assembled positions on its cylinder block, while FIGS. 4*a*, 4*b* and 5 show the engine with the cylinder head having the other one of the two assembled positions on the cylinder block, the two assembled position being pivoted 180° from each other about an imaginary pivot center.

Referring now to FIGS. 1—3, the cylinder block 10 has four cylinders 12, each having a reciprocating piston 14 therein (see FIG. 3). The pistons 14 are connected to a crank shaft 16 in a conventional manner. The crank shaft 16 is rotatably supported in the cylinder block 10 and has its one end portion extending through one end face 18 of the cylinder block 10. The cylinder alter its layout of the intake and exhaust systems, without any design modification of parts, to be suitably fit in various specifications of cars. Thus the engine assmebly according to the present invention makes easy production management of engines when the same kind of engine must be mounted in different layouts. It also provides many advantages on the part of the service men.

What is claimed is:

1. An internal combustion engine assembly, comprising:

a cylinder block having a plurality of cylinders, each having a reciprocating piston therein, and a crank shaft rotatably supported therein and operatively connected with said pistons, said plurality of cylinders being arranged with their cylinder axes lying on a longitudinal line of said cylinder block;

said cylinder block having first and second end faces which are spaced apart a distance along said longitudinal line thereof, said crank shaft having one end projected outwardly from said cylinder block through said first end face of said cylinder block, said cylinder block having a plurality of lubricating oil ports formed within an area adjacent to said second end face thereof;

a chain cover secured to said first end face of said cylinder block, said chain cover and said first end face cooperating to form a chamber;

a cylinder head having a plurality of combustion recesses corresponding in number to said plurality of cylinders and arranged along a longitudinal line thereof;

said cylinder head having first and second end faces which are spaced a distance along said longitudinal line thereof, said cylinder head being hollow and provided with a first set of oil lubricating ports corresponding in number to said plurality of lubricating oil ports of said cylinder block and disposed within an area adjacent to said first end face of said cylinder head, and also provided with a second set of oil lubricating ports corresponding in number to said plurality of lubricating oil ports of said cylinder block and within an area adjacent to said second end face of said cylinder head;

a cam shaft adapted to be rotatably journalled within said cylinder head, said cam shaft having a first end and a second end, one of said ends projecting outwardly from said cylinder head;

drive means for connecting said crank shaft and said cam shaft, said drive means including a pair of sprockets adapted to be mounted on the projected end of said crank shaft and on either end of said cam shaft, respectively, and a timing chain adapted to cooperate with said sprockets;

a casing adapted to be mounted on either end face of said cylinder head for closing the chamber of said chain cover;

said cylinder head having first and second assembled positions on said cylinder block, said first and second positions being located 180° apart, said combustion recesses closing said cylinders in either of said assembled positions;

said cylinder head, in said first assembled position, having its first end face aligned with said second end face of said cylinder block, said first set of lubricating oil ports in said cylinder head mating with said plurality of oil ports in said cylinder block and said second set of lubricating oil ports opening to the chamber of said chain cover, said cam shaft being journalled in said cylinder head with its first end projecting outwardly from said second end face of said cylinder head and said casing being mounted on said second end face of said cylinder head and cooperating with said chain cover to form a closed chamber for lubricating said sprockets and said timing chain;

said cylinder head, in said second assembled position, having its second end face aligned with said second end face of said cylinder block, said second set of lubricating oil ports in said cylinder head mating with said plurality of oil ports in said cylinder block and said first set of lubricating oil ports opening to the chamber of said chain cover, said cam shaft being journalled in said cylinder head with its first end projecting outwardly from said first face of said cylinder head and said casing being mounted on said first end face of said cylinder head and cooperating with said chain cover to form a closed chamber for lubricating said sprockets and said timing chain.

2. An assembly as claimed in claim 1, in which said cylinder block has a plurality of cooling liquid ports of a cooling liquid system and said cylinder head has a plurality of cooling liquid ports which mate with respective ones of said cooling liquid ports of said cylinder block when said cylinder head is in either of said two assembled positions on said cylinder block, to form part of the liquid cooling system.

* * * * *

United States Patent [19]

Yamada

[11] 4,121,559

[45] Oct. 24, 1978

[54] LUBRICANT OIL PUMP FOR TWO-CYCLE ENGINES

[75] Inventor: Seiichiro Yamada, Hamamatsu, Japan

[73] Assignee: Yamaha Hatsudoki Kabushiki Kaisha, Iwata, Japan

[21] Appl. No.: 754,404

[22] Filed: Dec. 27, 1976

[30] Foreign Application Priority Data

Dec. 29, 1975 [JP] Japan ..... 50-158839

[51] Int. Cl.[2] ..... F01M 1/00

[52] U.S. Cl. ..... 123/196 R; 184/27 R

[58] Field of Search ... 123/73 AD, 140 MP, 140 MC, 123/196 R; 60/601; 184/27 R, 32, 33; 417/214, 218

[56] References Cited

U.S. PATENT DOCUMENTS

| | | | |
|---|---|---|---|
| 2,183,035 | 12/1939 | Weber et al. | 123/140 MP |
| 2,621,674 | 12/1952 | DuRosta | 123/140 MP |
| 2,734,729 | 2/1956 | Loftin | 123/140 MP |
| 2,776,720 | 1/1957 | Reggio | 60/601 |
| 2,796,055 | 6/1957 | Cornelius | 123/140 MC |
| 2,894,735 | 7/1959 | Zupanic | 123/140 MC |
| 2,927,570 | 3/1960 | Pringham | 123/140 MP |
| 3,064,636 | 11/1962 | Dahl | 123/140 MP |
| 3,386,427 | 6/1968 | Powell et al. | 60/601 |
| 3,757,796 | 9/1973 | Boue et al. | 123/140 MP |
| 4,036,326 | 7/1977 | Muhai et al. | 184/33 |

*Primary Examiner*—Charles J. Myhre
*Assistant Examiner*—David D. Reynolds
*Attorney, Agent, or Firm*—Fleit & Jacobson

[57] ABSTRACT

Positive displacement type oil pump for two cycle engines, which is variable in displacement. The pump is provided with a pressure responsive diaphragm which is used to control the pump displacement. The diaphragm is subjected to the engine exhaust gas pressure so that the pump displacement is controlled in response to a change in the engine speed as well as to a change in the engine throttle valve opening.

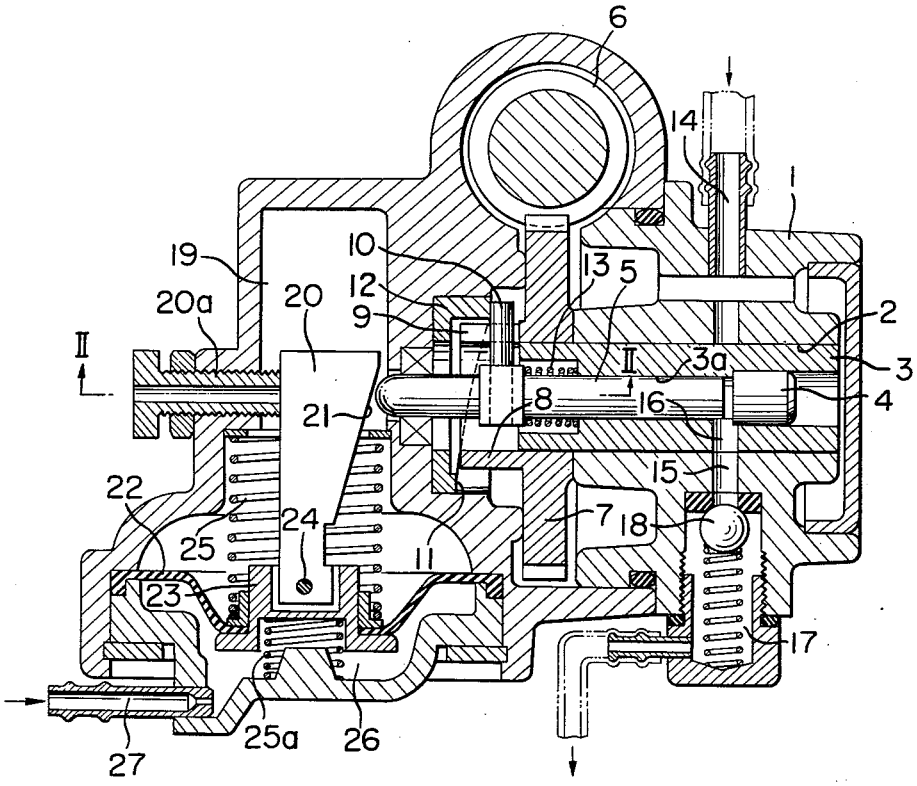

5 Claims, 4 Drawing Figures